US005148603A

United States Patent [19]

Beutler

[11] Patent Number: 5,148,603

[45] Date of Patent: Sep. 22, 1992

[54] ILLUMINATED REAR PEEP SIGHT FOR A PROJECTILE DEVICE

[75] Inventor: Robert C. Beutler, Sand Creek, Mich.

[73] Assignee: Kenneth Robertson, Toledo, Ohio ; a part interest

[21] Appl. No.: 767,990

[22] Filed: Sep. 30, 1991

[51] Int. Cl.[5] ..... F41B 5/00

[52] U.S. Cl. ..... 33/265

[58] Field of Search ..... 33/265, 241; 124/87

[56] References Cited

U.S. PATENT DOCUMENTS

| | | | |
|---|---|---|---|
| 2,171,571 | 9/1939 | Karnes | 33/241 |
| 3,410,644 | 11/1968 | McLendon | 33/265 |
| 4,220,983 | 9/1980 | Schroeder | 33/265 X |
| 4,625,422 | 12/1986 | Carlson | 33/265 |
| 4,848,306 | 7/1989 | Treaster | 33/265 X |
| 4,977,677 | 12/1990 | Troescher | 33/265 |

*Primary Examiner*—Harry N. Haroian
*Attorney, Agent, or Firm*—William J. Clemens

[57] ABSTRACT

A rear peep sight apparatus for use with a projectile device such as a bow includes a body formed of a transparent material for mounting in a bow string. The body has generally parallel front and rear surfaces connected by a curved side surface and the side surface and a portion of each of the front and rear surfaces is opaque. The body has a cavity formed therein for mounting a light source which is either self contained or connected by a spiral wound elastic conductor to a battery and switch enclosed in a housing which can be releasably attached to the bow. The peep sight can include a sighting device such as, for example, an oval ring, a dot and a cross hair. In the alternative, the light source can be located in the housing and the light transmitted through a fiber optic conductor to the body. As another alternative, the sighting device can be a centrally located aperture formed at an angle through the body surrounded by a first plurality of locator apertures formed in the body in the shape of a cross hair and a second plurality of target apertures formed in the body at the angle and positioned between the locator apertures and the centrally located aperture.

22 Claims, 3 Drawing Sheets

ILLUMINATED REAR PEEP SIGHT FOR A PROJECTILE DEVICE

This application is a continuation-in-part of U.S. patent application Ser. No. 07/715,432 filed on Jun. 14, 1991.

BACKGROUND OF THE INVENTION

The present invention relates generally to an apparatus for projectile device sighting and, in particular, to a bow string mounted rear sight assembly.

An archer, operating a bow, mounts a nock of an arrow at a nocking point on a bow string of the bow prior to drawing the bow string. A shaft of the arrow is placed on a arrow rest position generally at a midpoint on one side of the bow. The archer then draws the bow string back generally using the fingers of one hand while holding the bow with the opposite hand. Traditionally, to establish proper arrow trajectory once the bow string is fully drawn, the archer typically placed the hand griping the bow string at a reference point on or near the archer's face and also aligned his eye directly behind a vertical plane passing through the side of the bow against which the arrow is rested and the drawn bow string for target sighting.

Such a target sighting process was prone to error. To improve the accuracy and precision of the sighting process, bows and bow strings were provided with various sighting devices to assist the archer in establishing proper arrow trajectory.

Such sighting devices have included sighting pins for installation on the bow and peep sights for installation in or on the bow string. Sighting pins are adjustably mounted on and extend horizontally from the bow at a preset position above the arrow rest and are used in conjunction with a peep sight mounted in spaced relation above the nocking point so as to be in the line of sight of the archer. Thus, use of peep sights and sighting pins improve the archer's ability to establish proper arrow alignment and trajectory. A typical peep sight having an angled bore is shown in U.S. Pat. No. 4,116,194.

In low light conditions, however, target sights are difficult or impossible to use. One solution, associated with fire arms, has been to provide an illuminated sight. U.S. Pat. Nos. 2,987,821, 3,678,590 and 3,914,873 disclose lighted sights for guns.

Lighted front sights and sighting pins have been used with bows. For example the following U.S. Pat. Nos. show lighted front sights for bows: 4,177,572; 4,215,484; 4,638,565; 4,689,887; 4,928,394; 4,953,302; and 4,977,677.

The traditional peep sights also have been difficult to use in low light conditions. Such peep sights are shown in the U.S. Pat. Nos. 3,703,770, 3,703,771, 3,859,733 and 4,011,853.

SUMMARY OF THE INVENTION

The present invention concerns a peep sight assembly for use with a projectile device such as an archery bow or a gun. For use with a bow, the assembly includes a rear peep sight having a generally oval body formed of transparent material for mounting in a bowstring, the body having generally parallel front and rear surfaces connected by a curved side surface, the side surface and a portion of each of the front and rear surfaces being opaque, and the body having a cavity formed therein. A light source is mounted in the cavity for illuminating at least a central portion of the body.

If the light source is a lamp, an electrical conductor can be connected between the lamp and a source of electrical power.. If the power source is mounted on the bow, the conductor can be spiral wound and elastic for extending as the bow is drawn and retracting when the bow is released. In the alternative, the lamp and the power source can be mounted in the cavity, or the lamp and the power source can be mounted on the bow and the conductor can be a fiber optic conductor between the lamp and the peep sight body. The light source also can be a light emitting material contained in a housing mounted in the cavity.

The source of electrical power can include a housing enclosing a battery electrically connected to the light source and attachment means, such as a hook and loop fastener, for releasably attaching the housing to the bow. An on/off switch is attached to the housing and connected in series with the light source and the battery. The light source can be any suitable device such as an incandescent lamp or a light emitting diode. In an alternate embodiment, the light source, the switch and the battery all can be mounted in the cavity formed in the peep sight body.

A sighting means is formed on at least one of the front and rear surfaces. The sighting means can be of any suitable form such as an oval ring, a dot, or a cross hair. The sighting means can be formed of opaque material applied to the surface of the body, a ring or tube inserted in the body, one or more apertures formed in the body, or any combination thereof.

In an alternative embodiment, the body is formed from an opaque material and the sighting means includes a centrally located aperture formed at an angle through said body and means for transmitting light includes a first plurality of locator apertures formed in the body in the shape of a cross hair and a second plurality of target apertures formed in the body at the angle and positioned between the locator apertures and the centrally located aperture. The body also can be formed from a rear plate of opaque material in which the apertures are formed and an abutting front plate of transparent material. In either case, the light can be ambient light transmitted through the apertures or one of the light sources described above.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
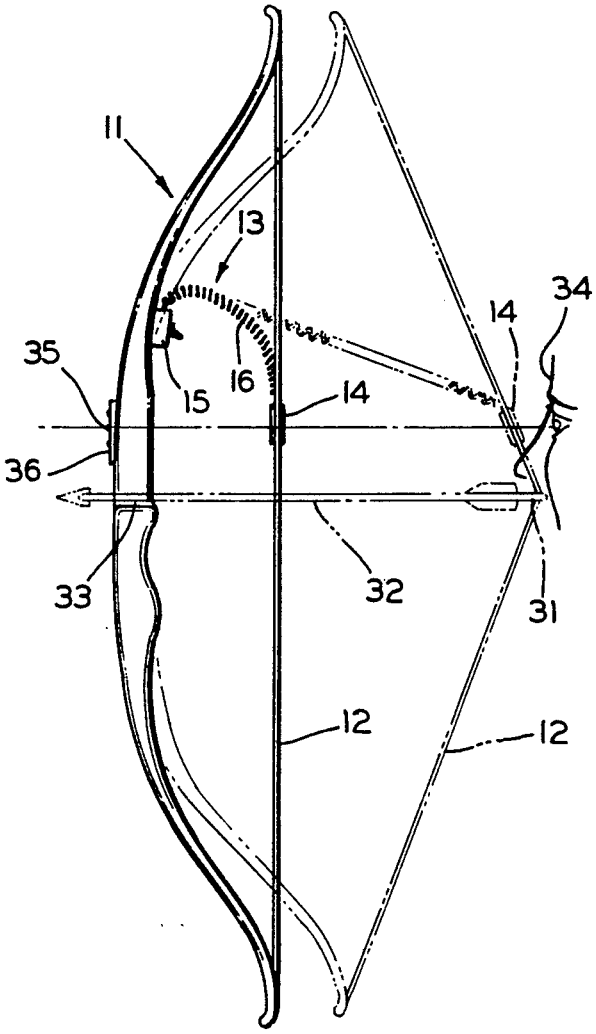
FIG. 1 is a side elevation view of an undrawn bow having a rear peep sight assembly in accordance with the present invention mounted on the bowstring.

There is shown in the FIG. 1 a bow 11 strung with a bow string 12 and having a peep sight assembly 13 mounted thereon. The assembly 13 includes a rear peep sight 14 mounted in the bow string 12, a power supply and switch assembly 15 attached to a rearwardly facing surface of the bow 11 and an electrical conductor 16 connected between the peep sight 14 and the power supply 15.

Figure 2:
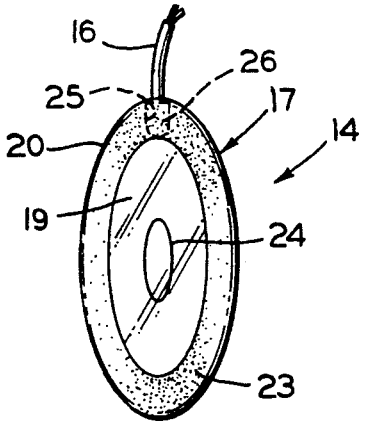
FIG. 2 is an enlarged rear elevation view of the peep sight apparatus shown in the FIG. 1.
Figure 3:
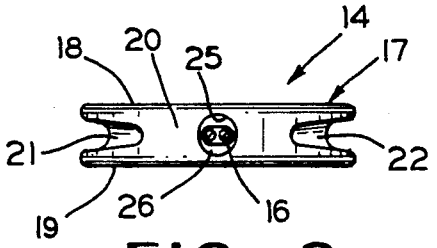
FIG. 3 is a top plan view of the peep sight apparatus shown in the FIG. 2.
Figure 4:
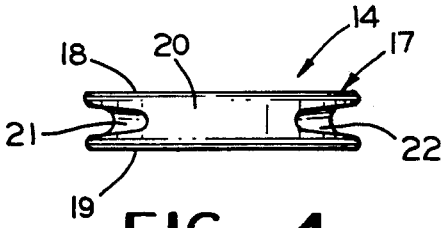
FIG. 4 is a bottom plan view of the peep sight apparatus shown in the FIG. 2.

As shown in the FIGS. 2 through 4, the rear peep 14 has a generally oval-shaped solid body 17 including generally parallel planer front surface 18 and rear surface 19. The surfaces 18 and 19 are connected by a curved side surface 20 extending completely around the body 17 and having a pair of opposed concave slots 21 and 22 formed therein. The bow string 12 is typically formed of a plurality of strands which can be separated into two generally equal size groups which are retained in the slots 21 and 22 when the body 17 is mounted in the bow string 12.

The body 17 of the rear peep sight 14 is typically formed of a transparent material. The side surface 20 and the peripheral portions of the front surface 18 and the rear surface 19 can be rendered opaque by any suitable means such as a non-glare coating 23. As shown in the FIG. 2, the coating 23 leaves a central portion of the rear surface 19 transparent. The coating 23 is formed in a similar manner on the front surface 18 such that an archer can look through the rear peep sight 14 when sighting the bow 11. As a sighting aid, an oval-shaped ring 24 can be formed in the center of the rear surface 19 or the front surface 18 or anywhere in between to function as a sighting means.

The body 17 also has a cavity 25 formed at an upper portion of the side surface 20. The cavity 25 receives a lamp 26. The lamp 26 is electrically connected to the conductor 16 which can be a two wire conductor as shown.

The rear peep sight 14 can be configured otherwise than as shown and still perform its intended function. For example, the ring 24 can represent the wall of an oval-shaped aperture formed in the center of the body 17 as a sighting means. The ring 24 also could be a wall of a tube inserted in an oval-shaped aperture formed in the body 17 as a sighting means. Of course, the body 17 does not have to be oval-shaped. The body 17 could be of a rectangular shape or any other desired shape for supporting the sighting means.

Figure 5:
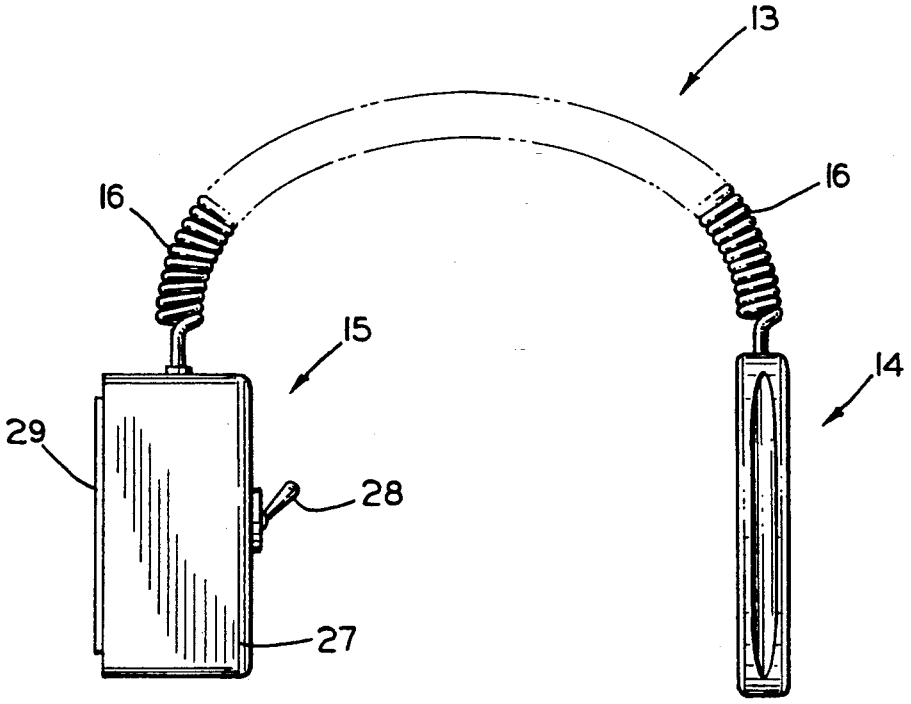
FIG. 5 is an enlarged side elevation view of the rear peep sight assembly shown in the FIG. 1.

There is shown in the FIG. 5 the peep sight assembly 13 consisting of the rear peep sight 14, the power supply 15 and the conductor 16. The power supply 15 can include a housing 27 enclosing a battery (not shown). Attached to the housing 27 is a switch 28 which is connected to the battery (not shown) and to the conductor 16 as described below. Also attached to the housing 27 and mounted on an external surface thereof is an attachment device 29. The attachment device can be, for example, a hook and loop type fastener for releasably attaching the housing 27 to the bow 11.

Figure 6:
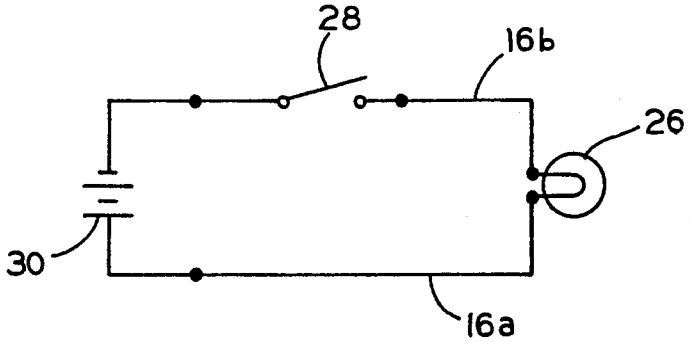
FIG. 6 is an electrical circuit schematic of the rear peep sight assembly shown in the FIG. 1.

An electrical circuit schematic of the peep sight assembly 14 is shown in the FIG. 6. A filament of the lamp 26 is connected to one end of each of the two wires of the conductor 16. A wire 16*a* is connected between one end of the filament of the lamp 26 and a positive terminal of a power supply such as a battery 30. The other wire 16*b* is connected between the other end of the filament of the lamp 26 and one terminal of the switch 28. The other terminal of the switch 28 is connected to a negative terminal of the battery 30. The switch 28 is a single pole on/off switch utilized to turn the lamp 26 on and off. When turned on, the lamp 26 provides light to the interior of the peep sight body 17. The coating 23 prevents the light from escaping through the side surface 20 and the peripheral portions of the front surface 18 and the rear surface 19. The coating 23 can be reflective on the interior surface. Thus, the light from the lamp 26 is concentrated in the center of the body to illuminate the oval ring 24 when external illumination is insufficient for the archer to accurately locate the ring 24.

As shown in the FIGS. 1 and 5, the conductor 16 is coiled much like the cord between the hand set and the base of a conventional telephone. The length of the conductor 16 is selected such that when the bow is at rest, as shown in the FIG. 1, the conductor is tightly coiled but extends in a relatively straight line between the rear peep sight 14 and the power supply 15. When the bow string 12 is fully drawn as shown in phantom, the nock 31 of an arrow 32 engages the string 12. The shaft of the arrow 32 extends forward and rests against an arrow rest 33 on the bow 11. An archer 34 can sight through the rear peep sight 14 in order to align a target (not shown) with an appropriate pin 35 of a front sight 36 mounted on a front surface of the bow 11.

As an alternative, the lamp 26 could be located in the housing 27 and the conductor 16 could be a fiber optic conductor. In that case, the end of the conductor 16 in the housing 27 would be located adjacent to the lamp 26 and light would be transmitted through the conductor 16 to the end attached to the rear peep sight 14.

Figure 7:
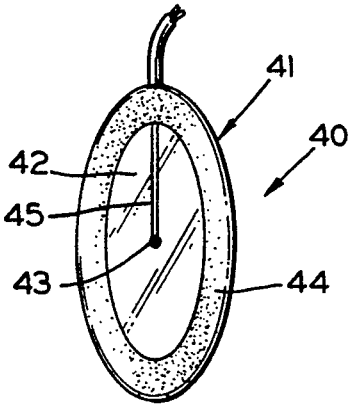
FIG. 7 is a rear elevation view, similar to the FIG. 2, of an alternate embodiment of the rear peep sight apparatus according to the present invention.

Although the rear peep sight 14 has been shown with an oval ring 24 located at its center, any other suitable sighting aid can be utilized. For example, as shown in the FIG. 7, a rear peep sight 40, similar to the rear peep sight 14, has a generally transparent body 41 with a rear surface 42. Located at the center of the rear surface 42 is a dot 43 which can be utilized by the archer 34 shown in the FIG. 1 as a sighting means to align with the pin 35. In the alternative, that portion of the body 41 interior of a periphery which has a coating 44 applied thereto can be formed as an aperture. The dot 43 can be supported by a support column 45 connected between the dot 43 and a wall of the aperture in the body 17. The column 45 can transmit light from the light source to illuminate the dot 43.

Figure 8:
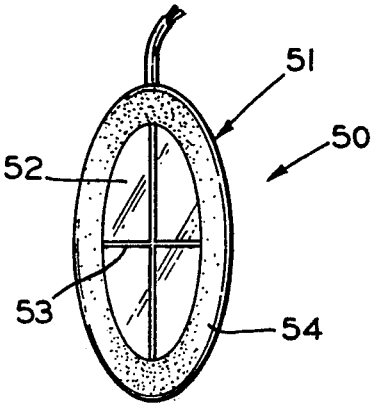
FIG. 8 is a rear elevation view, similar to the FIG. 2, of a second alternate embodiment of the rear peep sight apparatus according to the present invention.

A second alternate embodiment of the present invention is shown in the FIG. 8 as a rear peep sight 50. The peep sight 50 has a generally transparent body 51 with a rear surface 52 having a cross hair 53 formed thereon. The cross hair 53 can be utilized by the archer 34 shown in the FIG. 1 as a sighting means to align the pin 35 with the target. Alternatively, that portion of the body 51 interiorly of a periphery which has a coating 54 applied thereto can be formed as an aperture. In that case, the cross hair 53 can be formed as light transmitting walls or columns supported by connection to the wall of the aperture formed in the body 17.

Figure 9:
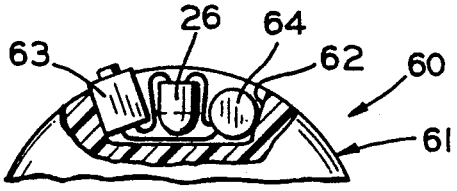
FIG. 9 is an enlarged fragmentary rear elevation view of a third alternate embodiment of the rear peep sight assembly according to the present invention.

There is shown in the FIG. 9 an alternate embodiment of the rear peep sight assembly in accordance with the present invention. This assembly is self contained with all of the elements being mounted on the bow string. A rear peep sight 60 has a body 61 which is similar to the peep sight body 17 shown in the FIG. 2. However, a larger cavity 62 has been provided in place of the cavity 25. Mounted in the cavity 62 with the lamp 26 is a switch 63 and a battery 64. The switch 63 is a push button switch which operates in a manner similar to the switch 28. The battery 64 is a miniature battery which supplies electrical power in a manner similar to the battery 30. The lamp 26, the switch 63 and the battery 64 are connected in series in accordance with the schematic diagram of the FIG. 6.

Figure 10:
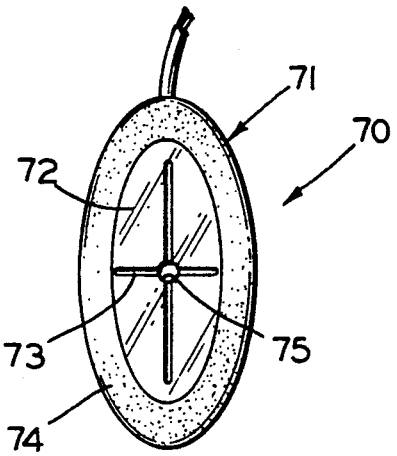
FIG. 10 is a rear elevation view, similar to the FIG. 2, of a fourth alternate embodiment of the rear peep sight apparatus according to the present invention.

A fourth alternate embodiment of the present invention is shown in the FIG. 10 as a rear peep sight apparatus 70. The peep sight 70 has a generally transparent body 71 with a rear surface 72 having a cross hair 73 formed thereon. The cross hair 73 can be utilized by the archer 34 shown in the FIG. 1 as a sighting means to align the pin 35 with the target. A portion of the body 71 interiorly of a periphery which has an opaque coating 74 applied thereto can be formed as an aperture 75. The cross hair 73 can be formed as light transmitting grooves extending into the rear surface 72 and the walls of the grooves will be lighted by a source of light such as the lamp 26 shown in the FIG. 2 or the FIG. 9.

Figure 11:
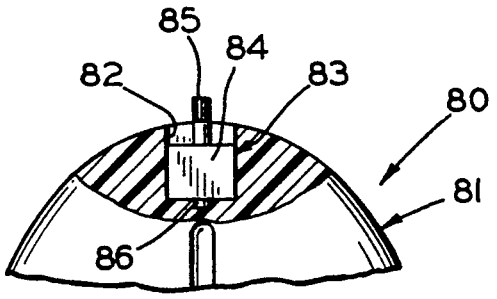
FIG. 11 is an enlarged fragmentary rear elevation view, similar to the FIG. 9, of a fifth alternate embodiment of the rear peep sight apparatus according to the present invention.

There is shown in the FIG. 11 a fifth alternate embodiment of the rear peep sight assembly in accordance with the present invention. This assembly is self contained with all of the elements being mounted on the bow string. A rear peep sight 80 has a body 81 which is similar to the peep sight body 17 shown in the FIG. 2. However, a larger cavity 82 has been provided in place of the cavity 25. Mounted in the cavity 82 is a light source 83 including a housing 84. A rod-like actuator 85 extends outwardly from the housing 84 and the body 81 for rotation about its longitudinal axis for turning on and off the light. The lens 86 extends inwardly toward the center of the body 81. The housing 84 contains a small quantity of a suitable radioactive light-emitting material which supplies light through the lens 86. For example, the material can be radioactive tritium in gaseous form in a quantity of about ten to fifteen millicuries. The lens 86 is opened and closed by rotating the actuator 85 in opposite directions.

Figure 12:
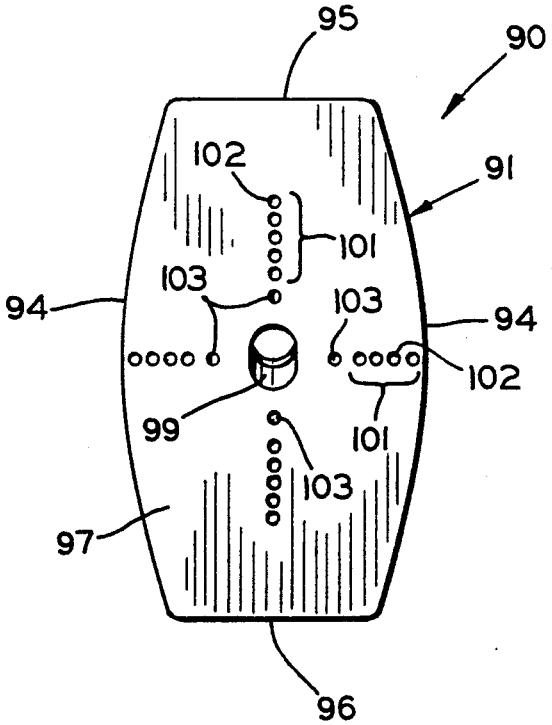
FIG. 12 is a rear elevation view, similar to the FIG. 2, of a sixth alternate embodiment of the rear peep sight apparatus according to the present invention.
Figure 13:
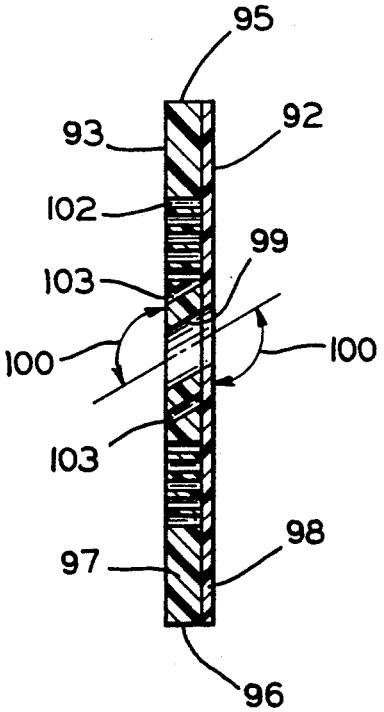
FIG. 13 is a side elevation view of the rear peep sight apparatus shown in the FIG. 12.

As shown in the FIGS. 12 and 13, a sixth embodiment rear peep 90 has a generally oval-shaped body 91 including generally parallel planer front surface 92 and rear surface 93. The surfaces 92 and 93 are connected by a pair of curved side surfaces 94 extending between generally parallel flat upper surface 95 and bottom surface 96. The side surfaces 94 could extend completely around the body 91 similar to the surface 20 shown in the FIG. 2. Although not shown, the surfaces 94 have a pair of opposed concave slots, such as the slots 21 and 22, formed therein. The bow string 12 is typically formed of a plurality of strands which can be separated into two generally equal size groups which are retained in the slots 21 and 22 when the body 91 is mounted in the bow string 12.

The body 91 can be formed from a pair of plates such as a rear plate 97 and a front plate 98 abutting at facing surfaces. A centrally located sighting aperture 99 is formed through the plates 97 and 98. The aperture 99 is formed with its longitudinal axis at an angle 100 with respect to the planes of the front and rear surfaces 92 and 93. The angle 100 is selected such that when the bow 11 is undrawn, as shown by the solid lines in the FIG. 1, the body 91 is oriented in a generally vertical plane and the opposite ends of the aperture 99 are misaligned with respect to a generally horizontal plane as shown in the FIG. 12. When the bow 11 is drawn, as shown by the phantom lines in the FIG. 1, the body 91 is oriented at an angle and the opposite ends of the aperture 99 are aligned to present a generally circular sighting bore to the archer 34.

As an aid in seeing the aperture 99, especially in low ambient light conditions, a cross hair 101 is formed by a plurality of relatively small diameter locator apertures 102 each having a longitudinal axis generally perpendicular to the surface 93 and extending through the rear plate 97. Of course, any suitable pattern could be used for the apertures 102. If the rear plate 97 is formed from an opaque material and the front plate 98 is formed from a transparent material, light from the side 92 can be seen through the locator apertures 102 by the archer positioned on the side 93. The light can be from any suitable source such as ambient light or the lamp 26 or the light source 83. The plate 98 can be formed from a colored transparent material such as a plastic to provide a contrast to the aperture 99.

Also formed in the plate 97 are a plurality of target apertures 103, one such aperture 103 positioned between the inner ends of the rows of locator apertures 102 and the center aperture 99. The apertures 103 are formed through the plate 97 at the same angle 100 as the center aperture. Through the proper selection of the thickness of the plate 97 and the diameter of the apertures 102 and 103, the archer will see only the light through the locator apertures 102 when the bow 11 is undrawn. As the bow is drawn, the light from the side 92 will change becoming reduced in intensity until it is blocked by the walls of the apertures 102 and will become visible through the target apertures 103 and increase in intensity to a maximum when the bow is fully drawn. The total change in the transmitted light will depend upon the number and size of the apertures 102 and 103. The angle 100 is coordinated with the draw length and the length of the bow to provide for the above-described operation of the rear peep sight apparatus 90. Such operation allows the archer to accurately "snap" shoot as soon as the bow is drawn to the proper position as indicated by the appearance of light through the target apertures 103.

Too much light close to the eye of the archer makes it difficult to see the front sight 36. Thus, the target apertures 103 can be formed with a smaller diameter than the locator apertures 102. If ambient light is to be the light source, the front plate 98 could be eliminated. For a light source such as the lamp 26 or the gas light 83, the light source can be mounted on the side 92 or in a cavity such as shown in the FIGS. 3, 9 and 11.

Although all of the rear peep sights according to the present invention have been described and shown as applied to a bow, such sights also could be applied to other types of projectile devices such as rear sights for firearms.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A rear peep sight apparatus for use with a projectile device comprising:

a body having spaced apart front and rear surfaces, at least a portion of said rear surface being opaque;

means for mounting said body on a projectile device at a rear peep sight position;

a sighting means on said body separate from said opaque portion of said rear surface for aligning with a target positioned in front of said front surface and viewed from said rear surface through said body; and means for transmitting light from a light source through said body to illuminate an area of said body on said rear surface about said sighting means.

2. The apparatus according to claim 1 wherein said body has generally parallel front and rear surfaces connected by a curved side surface.

3. The apparatus according to claim 2 wherein said body is formed from a transparent material and said side surface and a portion of each of said front surface and said rear surface is opaque.

4. The apparatus according to claim 1 wherein said means for mounting includes a pair of opposed concave slots formed in said body for receiving strands of a bowstring.

5. The apparatus according to claim 1 including a light source and wherein said body has a cavity formed therein for receiving said light source.

6. The apparatus according to claim 5 wherein said light source includes an electric lamp and a source of electrical power connected to said lamp.

7. The apparatus according to claim 5 wherein said light source includes a housing containing a light emitting material and mounted in said cavity.

8. The apparatus according to claim 1 including a light source and a fiber optic conductor connected between said light source and said body.

9. The apparatus according to claim 1 wherein said body has an aperture formed therein and said sighting means is supported by connection to a wall of said aperture.

10. The apparatus according to claim 1 wherein said sighting means is formed in the shape of an oval ring.

11. The apparatus according to claim 1 wherein said sighting means is formed in the shape of a dot.

12. The apparatus according to claim 1 wherein said sighting means is formed in the shape of a cross hair.

13. The apparatus according to claim 12 wherein said cross hair is formed from a plurality of grooves extending into an outer surface of said body.

14. The apparatus according to claim 12 wherein said cross hair includes a first plurality of locator apertures formed in said body and a second plurality of target apertures formed in said body at an angle to said locator apertures.

15. The apparatus according to claim 1 wherein said sighting means includes at least one locator aperture formed in said body and at least one target aperture formed in said body at an angle to said locator aperture.

16. A peep sight apparatus for use with a projectile device comprising:

a body having means for mounting on a projectile device, said body having generally parallel front and rear surfaces connected by a curved side surface;

sighting means supported on said body; and means for transmitting light from said front surface of said body to an area of said rear surface of said body for illuminating said sighting means.

17. The apparatus according to claim 16 wherein said body is formed from an opaque material, said sighting means includes a centrally located aperture formed at an angle through said body and said means for transmitting light includes a first plurality of locator apertures formed in said body and a second plurality of target apertures formed in said body at said angle.

18. The apparatus according to claim 16 wherein said body includes a rear plate formed from an opaque material and a front plate formed from a transparent material and abutting said rear plate, said sighting means includes a centrally located aperture formed an an angle through said rear plate and said means for transmitting light includes a first plurality of locator apertures formed in said rear plate and a second plurality of target apertures formed in said rear plate at said angle.

19. The apparatus according to claim 16 wherein said body is formed from an opaque material, said sighting means includes a centrally located aperture formed at an angle through said body and said means for transmitting light includes a first plurality of locator apertures formed in said body in the shape of a cross hair and a second plurality of target apertures formed in said body at said angle and positioned between said locator apertures and said centrally located aperture.

20. A peep sight apparatus for use with a projectile device comprising:

a body for mounting on a projectile device, said body having generally parallel front and rear surfaces connected by side surfaces, said side surfaces and at least a portion of each of said front and said rear surfaces being opaque;

a sighting means including a centrally located aperture formed at an angle through said body; and means for transmitting light from said front surface to an area on said rear surface about said centrally located aperture including a first plurality of locator apertures formed in said body in the shape of a cross hair and a second plurality of target apertures formed in said body at said angle and positioned between said locator apertures and said centrally located aperture.

21. The apparatus according to claim 1 wherein said sighting means includes a first aperture formed through said body between said front and rear surfaces and said means for transmitting light includes at least one other aperture formed in said body at said rear surface whereby when said body is rotated while said first aperture is maintained in alignment with the target, light transmitted through said other aperture changes in intensity.

22. The apparatus according to claim 1 wherein said sighting means includes a first aperture formed through said body between said front and rear surfaces and said means for transmitting light is formed in the shape of a cross hair having a first plurality of locator apertures formed in said body and a second plurality of target apertures formed in said body between said locator apertures and said first aperture and at an angle to said locator apertures.

* * * * *